United States Patent [19]

Hansen-Smith et al.

[11] Patent Number: 4,838,608

[45] Date of Patent: Jun. 13, 1989

[54] ADJUSTABLE BEACH CHAIR

[76] Inventors: Karen Hansen-Smith, 4456 Paces Battle Dr., Atlanta, Ga. 30327; John E. Lewis, 808 Mill Pond Dr., Smyrna, Ga. 30080

[21] Appl. No.: 183,599

[22] Filed: Apr. 19, 1988

[51] Int. Cl.[4] ..... A47C 1/026; A47C 5/10

[52] U.S. Cl. ..... 297/27; 297/360; 297/363; 297/419; 297/423

[58] Field of Search ..... 297/27–29, 297/31, 278, 279, 281, 359, 360, 363, 416, 419, 421, 423, 429

[56] References Cited

U.S. PATENT DOCUMENTS

| | | | |
|---|---|---|---|
| 104,398 | 6/1870 | Adams | 297/28 |
| 709,688 | 9/1902 | Vogel | 297/29 |
| 2,150,478 | 3/1939 | Yerrick | 297/419 X |
| 2,600,374 | 6/1952 | O'Neill | 297/429 X |
| 2,740,465 | 4/1956 | Mugler | 297/31 |
| 3,338,625 | 8/1967 | Jung-Shien | 297/18 |
| 4,514,009 | 4/1985 | Vanderminden | 297/359 X |

FOREIGN PATENT DOCUMENTS

| | | | |
|---|---|---|---|
| 247894 | 2/1926 | United Kingdom | 297/28 |
| 640619 | 7/1950 | United Kingdom | 297/29 |

*Primary Examiner*—Peter R. Brown

*Attorney, Agent, or Firm*—James B. Middleton

[57] ABSTRACT

A beach chair is made of three tubes, the tubes being bent three-dimensionally, and a method renders the forming economical. The three tubes are bent into the same shape, including parallel legs and a bend connecting the legs. The bend is also curved out of the plane of the parallel legs. The seat has a sling between two legs, and the bend turns down to act as a rear support; the back extends up from the seat; and, a support connects the seat and back for rigidity, and the bend turns down to act as a front support. An optional leg rest is the same shape again, having its legs attached to the seat, and its bend turning down to support the leg rest. To bend the tubing, a thermoplastic trough is shaped as desired, and a heated tube is conformed to the trough.

6 Claims, 2 Drawing Sheets

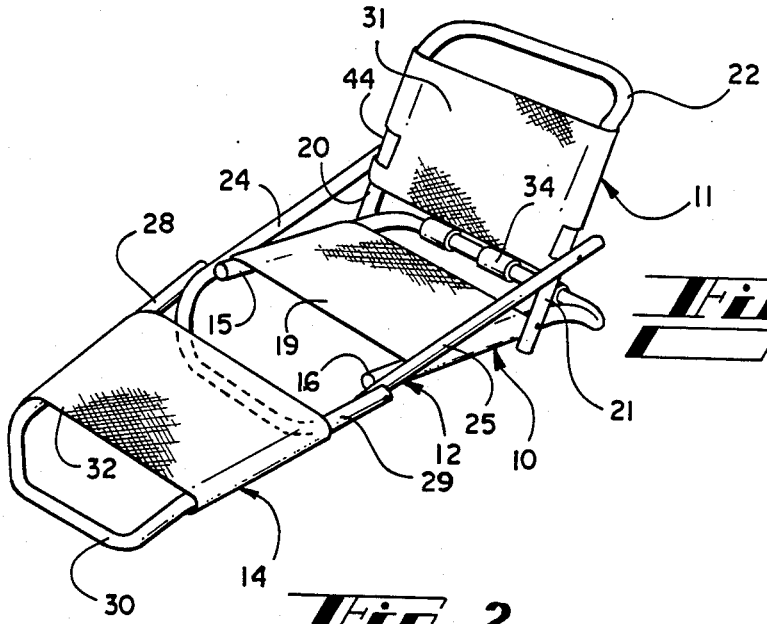
Fig_1
Fig_2
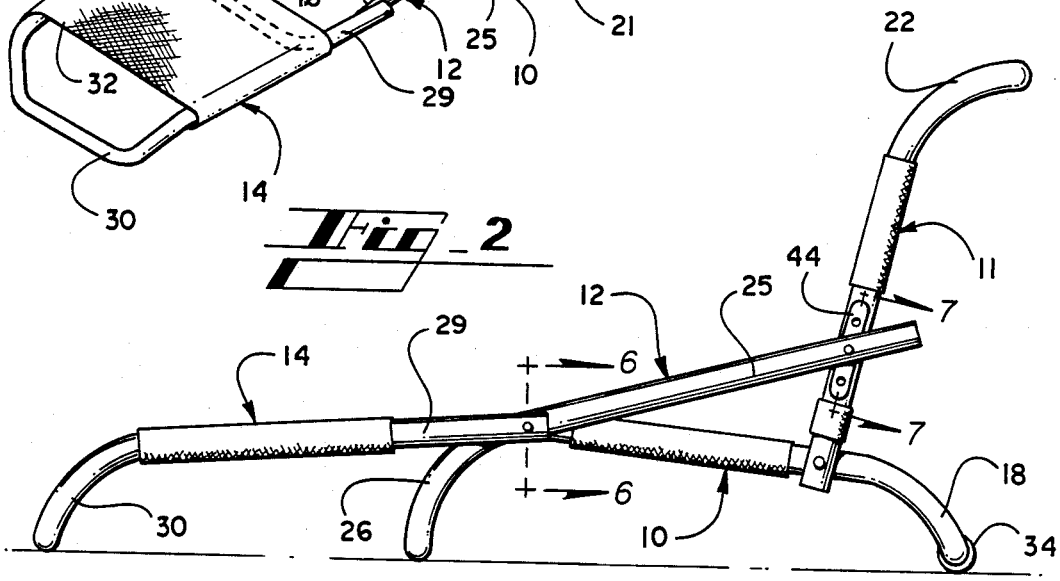
Fig_3
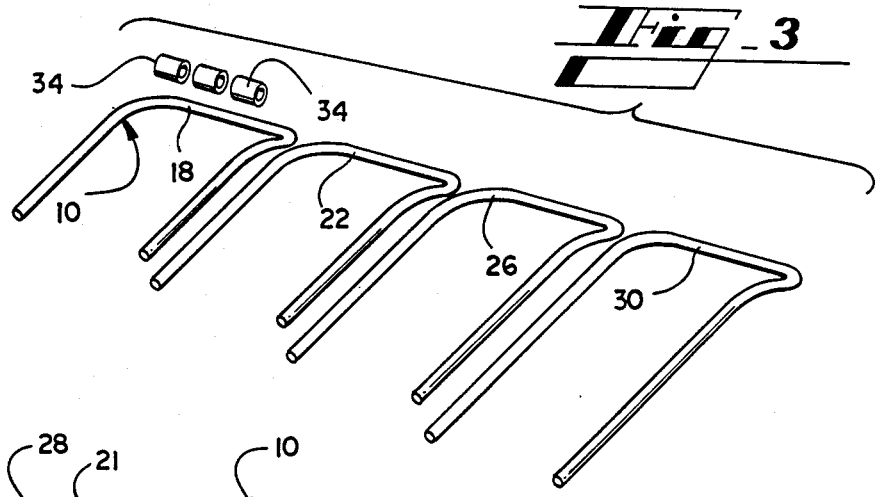
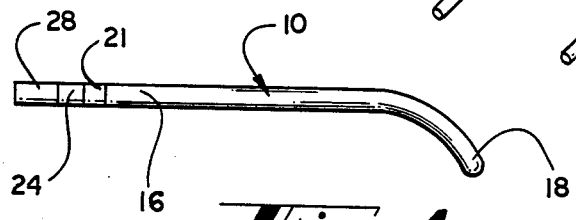
Fig_4

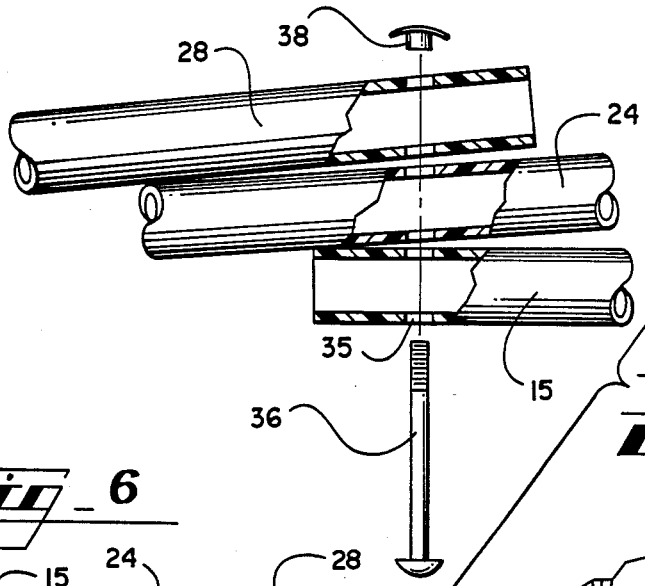
Fig_5
Fig_6
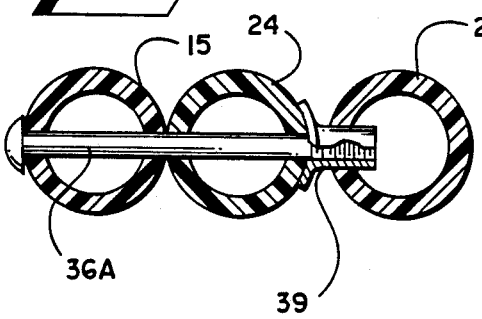
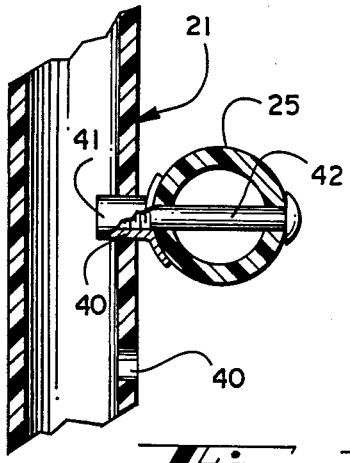
Fig_7
Fig_8
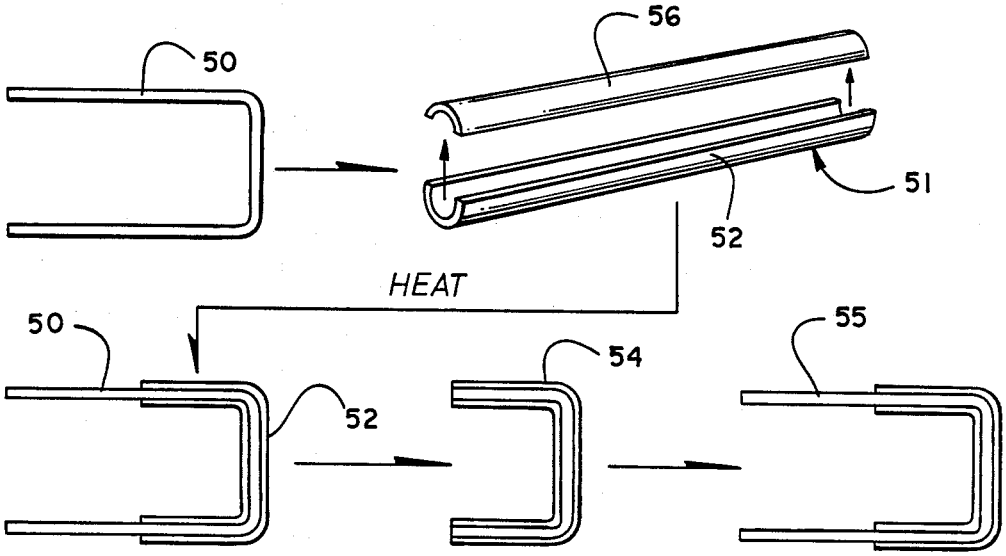

ADJUSTABLE BEACH CHAIR

INFORMATION DISCLOSURE STATEMENT

It is well known in the art to provide chairs, lounges and the like by fabricating the furniture of a plurality of shaped tubes, and to provide seat and back rests by means of some form of fabric, either in sheet form or in strips or the like. Such tubular furniture is normally made of either steel or aluminum tubing, the tubing frequently being bent to provide corners, and fastened together by means of a tubular splicing element.

More recently, many forms of furniture have been produced from tubing made of a plastic material such as polyvinylchloride (PVC), acrylonitrile-butadienestyrene (ABS) and other readily available materials. When fabricating furniture from plastic tubing, the tubing has been provided with corners by means of molded elbows, and splices have been made by means of generally conventional couplings. These fittings of course require that individual pieces of tubing be cut to length, and assembled using an appropriate adhesive and the pipe fittings. Such a process is somewhat time consuming and requires considerable energy for the multiple cuts.

SUMMARY OF THE INVENTION

This invention relates generally to furniture for the beach or the like, and is more specifically concerned with an adjustable beach chair made of formed plastic tubing.

The present invention provides an extremely simple chair that can be utilized either as a chair or as a lounge. Construction of the chair is rendered simple through the use of formed plastic tubing, the tubing being formed three dimensionally so that multiple functions are provided by a single piece of tubing. In one embodiment of the invention, a chair can be formed of only three pieces of tubing, a first member providing a seat and a rear support, a second piece providing a back rest, and third piece providing a front support and also acting to hold the back rest in position. Optionally, a leg rest can be provided by a fourth piece of tubing, the leg rest being attachable to the chair. All of the four pieces of tubing have the same three dimensional bend, the only difference in the three members being in the length of the straight legs of the different members.

The present invention also includes a method for providing the three-dimensional bend in the thermoplastic tubing. The method includes the steps of creating a first shape by hand work or the like, providing a thermoplastic trough sufficiently large to receive the first member, heating the trough to its plastic state, and shaping the trough to receive the first member. When the trough cools, the trough is usable as a mold. Thus, a straight pipe is heated to its plastic state, and placed into the formed trough, so the pipe takes the shape of the trough.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a chaise lounge made in accordance with the present invention;

FIG. 2 is a side elevational view of the lounge shown in FIG. 1;

FIG. 3 is an illustration showing the four pipe pieces used in assembly of the furniture shown in FIGS. 1 and 2;

FIG. 4 is a side elevational view of the four pipe pieces shown in FIG. 3;

FIG. 5 is an exploded view illustrating a connection means for the pipes for construction of the furniture of the present invention;

FIG. 6 is an enlarged cross-sectional view taken substantially along the line 6—6 in FIG. 2, the background being omitted for clarity;

FIG. 7 is an enlarged cross-sectional view taken approximately along the line 7—7 in FIG. 2; and, FIG. 8 is an illustration showing the steps for forming the tubing three dimensionally in accordance with the present invention.

DETAILED DESCRIPTION OF THE EMBODIMENT

Referring now more particularly to the drawings, and to that embodiment of the invention here presented by way of illustration, in FIG. 1 the invention is shown in the form of a chaise lounge having a seat member generally designated at 10, a back rest designated at 11, and a front support member generally designated at 12. The leg rest designated at 14 is attached to the front portion of the chair and is selectively removable from the chair.

With attention to FIGS. 1 and 2 of the drawings, it will be seen that the seat member 10 comprises a pair of generally parallel leg members 15 and 16 connected together by a bent portion 18. Again, looking at FIGS. 1 and 2 it will be seen that the bent portion 18 is bent downwardly from the plane of the seat 19. The bent portion 18 extends down between the legs 15 and 16, and also extends laterally to connect the legs 15 and 16. Thus, the tubing for providing a seat member 10 is bent three dimensionally rather than formed in only a single plane.

The back rest 11 is formed similarly to the seat member 10, the back rest 11 having leg members 20 and 21 extending generally parallel to each other, and a bent portion 22 connecting leg members 20 and 21. As with the seat member 10, it will be seen that the bent portion 22 is bent from the plane of the legs 20 and 21 and is also bent laterally to connect the two legs.

The third member to make up the chair is the front support member 12. The front support member 12 includes generally parallel leg members 24 and 25 connected by a bent portion 26. The bent portion 26 is, again, like the bent portion 18 of the seat member 10.

With the three members, it will be understood that a chair is provided with the bent portion 18 of the seat member 10 providing the rearmost support for the chair. The seat member 10 is connected to the front support member 12 so the bent member 26 provides the front support for the chair while the legs 24 and 25 of the support member 12 connect both to the seat member 10 and to the back rest 11. Thus, with the back rest 11 attached to the seat member 10 it will be understood that the entire chair is quite rigid and usable without anything additional.

When desired, one can also use the leg rest 14; and, the leg rest 14 is also formed in the same manner as the three pieces that make up the chair. The leg rest 14 includes parallel leg members 28 and 29 connected by a bent portion 30.

All of the usable surfaces of the chair and the lounge are provided by means of a fabric or comparable material extending between the opposite legs of the various members that make up the chair. Thus, there is a back sling 31 extending between the legs 20 and 21 of the back rest 11 for a person to lean against. The back sling 31 has appropriate cutouts to accommodate the legs 24 and 25 of the support member 12. The seat sling 19 has previously been mentioned, the seat sling 19 extending between the legs 15 and 16 of the seat member 10; and, a leg sling 32 extends between the legs 28 and 29 of the leg rests 14.

FIG. 3 of the drawings illustrates the four pieces of tubing utilized to make the lounge illustrated in FIGS. 1 and 2 of the drawings. It will be seen in FIG. 3 that all four of the pieces are formed identically, with the exception of the lengths of the legs of the individual members. Because of this fact, a single mold can be used to create the bent portions 18, 22, 26 and 30, and the legs can extend outwardly from the mold to any desired length.

Also shown in FIG. 3 is a plurality of rollers designated at 34. Since the seat member 10 is formed of a plastic tubing, it will be readily understood by those skilled in the art that a larger size of plastic tubing can be obtained, and discreet lengths cut from the plastic tubing. The rollers 34 are therefore cut from an appropriate piece of tubing so that the rollers 34 will slip over the legs 15 or 16 of the seat member 10. Because the material is somewhat elastic, the rollers 34 can be forced around corners to the center area of the bend 18. As is illustrated in FIGS. 1 and 2 of the drawings, the rollers 34 will then provide convenient wheels for the chair.

FIG. 4 of the drawings shows the four tubular members forming the chair of FIGS. 1 and 2 arranged side by side, and it will be readily seen that the bent portions are precisely the same for all four of the members.

Since the tubular members are identical except for the lengths of the respective legs, it will be readily understood that the parallelism of the opposed legs must be distorted in order to assemble the chair as shown in FIG. 1. As illustrated in FIG. 1, the seat member 10 has its legs 15 and 16 substantially parallel. Because of this, the leg members 20 and 21 of the back rest 11 must be made somewhat divergent to fit on the outside of the legs of the seat member 10. The support member 12 must then be distorted outwardly so the extending ends of the legs 24 and 25 can engage the outside of the legs of the back rest 11. Finally, the legs 28 and 29 of the leg rest 14 must be stretched outwardly so the extending ends of the legs 28 and 29 will fit outside the legs of the support member 12.

Since the tubular material is plastic, and usually has some rubber content, the tubular members are easily distortable to provide the arrangement illustrated in FIG. 1. It must be realized, however, that the various members must be fastened together in a manner to allow the described misalignment. FIG. 5 illustrates a connection by showing the arrangement for the legs 15, 24 and 28. It will be seen that the three legs must be arranged in their final condition, and held in that condition. While so held, a hole is drilled completely through the three legs, the hole in all three members being designated at 35. With the hole 35 being drilled completely through the three leg members, it will be understood that the hole will be straight to receive the screw 36. The screw 36 therefore passes completely through the three legs 15, 24 and 28, and receives a nut 38 on the opposite side. The screw 36 therefore acts both as a fastening means to hold the three members together, and also as a pivot axis to allow adjustment and folding of the chair of the present invention.

The arrangement shown in FIG. 5 will provide a substantially permanent connection between the three leg members; however, if the leg rest 14 is to be easily attachable and removable, the modification shown in FIG. 6 might be preferred. The arrangement shown in FIG. 6 includes the leg members 15 and 24 connected together by a screw designated at 36A. The end of the screw 36A is threaded to receive a barrel nut 39. It will be noted that the barrel nut 39 extends beyond the leg 24, and provides a pintle for selective receipt of the hole 28. It will therefore be readily seen that, by providing the pintle or the like, and a hole in the leg 28, the leg 28 can be easily attached to or removed from the pintle.

The arrangement shown in FIG. 7 is similar to that shown in FIG. 6, but is the reverse. FIG. 7 illustrates the connection of the legs 24 and 25 of the support member 12 to the back rest 11. Since the back rest 11 is preferably adjustable, it will be seen that there is a plurality of holes 40 in the leg members 20 and 21 for receipt of a pintle 41. The pintle 41 is, as before, provided by means of a barrel nut held in place by a screw 42. Therefore, due to the elasticity of the legs 24 and 25, the pintle 41 can be easily removed from or inserted into a selected one of the holes 40. As is well understood by those skilled in the art, the selection of a particular hole 40 will result in a variation in the positioning of the back rest 11.

From the foregoing description, the operation of the chair of the present invention should be understandable. The four members making up the chair will be formed having precisely the same shape for the bends 18, 22, 26 and 30, with only the leg length varying. The various members will be placed together in their final fashion, and appropriate holes such as the hole 35 will be drilled completely through the members. Screws can then be passed through the holes for fastening the various members together and providing pivot axes.

It will be noticed in FIGS. 6 and 7 that the threads on the screws 36A and 42 are at the tip only, the object being to assure that the threads on the screws are entirely received within the nuts 39 and 41. This is an important feature of the construction of the device because of the facts that the chair is constructed of plastic tube, and that the chair is adjustable.

To prevent the undesirable enlargement of the screw holes, the barrel nuts are used. When an external pintle is not desired, the barrel nut is turned in as shown in FIG. 5. The threads on the screw 36 will then be completely confined within the nut 38. When the external pintle is desired, the barrel nut is turned out as in FIGS. 6 and 7 and the threads on the screw are still completely confined within the barrel.

While the construction illustrated in FIG. 5 is described as being at the connection of the leg rest 14 to the seat member 10, it should be understood that the preferred arrangement is that shown in FIG. 6 which allows the leg rest to be selectively removed. The mechanical arrangement illustrated in FIG. 5, however, is used to connect the seat portion 10 to the back rest 11. This joint will remain together at all times, and will pivot for folding and adjusting the chair.

The fabric surfaces 19, 31 and 32 can be provided to fit the particular members. In making the fabric surfaces, it must be remembered that the legs such as the legs 20 and 21 are not parallel when the chair is assembled, so the back sling 31 must be made in a trapezoidal shape to conform to the nonparallel legs. Also, in the case of the back sling 31, cutouts 44 are provided in the vicinity of the holes 40 to allow connection of the legs 24 and 25 to the legs 20 and 21.

For the leg sling 32, it must also be remembered that the legs 28 and 29 are not parallel, so that the leg sling 32 must be trapezoidal in shape. Furthermore, in assembling the lounge of the present invention, the leg sling 32 must be slid downwardly towards the bend 30 to allow the legs 28 and 29 to be separated sufficiently to be received over the pintles for attachment to the chair. After the legs 28 and 29 have been appropriately attached to the pintles 39, the leg sling 32 can be slid towards the chair to hold the legs 28 and 29 together. A more secure chair is thereby formed.

With the above discussion of the construction of the chair of the present invention, the method for bending the tubular members should be understandable with only a brief discussion. Looking at FIG. 8, the tubular member 50 is shown as a simple U-shaped bend, but it will be understood that the tubular member 50 can be virtually any shape, in two or three dimensions. The tubular member 50 will generally be provided as a prototype by bending by hand or the like to achieve the desired shape. Further, the tubular member 50 may be plastic, aluminum, steel, or virtually any other material. The tubular member 50 is therefore only a prototype for the making of the mold.

Once the tubular member 50 is provided, a length of plastic tubing is obtained, the plastic tubing being of a diameter sufficient to receive the tubular member 50 therein. That is to say, the diameter of the tube making up the tubular member 50 must be substantially smaller than the diameter of the tube making up the tubular member 51. The tubular member 51 is then cut lengthwise to remove approximately a third of the tubular member. Therefore, a trough 52 is provided through the removal of the slab 56. The slab 56 is scrap, so it will be readily understood that other means for providing the trough 52 would be satisfactory, but it has been found that the cutting of a readily available tube 51 is a simple and efficient way to provide the trough 52.

Once the trough 52 is prepared, the trough 52 will be heated to its plastic state. While the trough 52 is plastic and moldable, the trough 52 will be placed around the tubular member 50. With the tubular member 50 lying within the trough 52, the trough 52 will be completely conformed to the tubular member 50 so that all portions of the bend in the tubular member 50 lie along the bottom of the trough 52. In this condition, the trough member 52 is allowed to cool and solidify so that it will retain the molded shape, producing a final mold indicated at 54.

Having the mold 54, it will now be readily understood that a length of plastic tubing 55 can be heated to its plastic state, and placed into the mold 54. By forcing the tubing 55 against the bottom of the mold 54, the tubing 55 will take the shape of the mold 54; hence the shape of the original tubular member, or prototype, 50.

It will therefore be seen that the present invention provides an extremely simple chair made of three pieces, with an optional fourth to convert the chair to a chaise lounge. The method for forming the tubular members comprising the chair renders the chair very economical to manufacture, and quite variable in its appearance and construction.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. In a beach chair, of the type having a tubular frame, with slings supported by said tubular frame for supporting a person thereon, said tubular frame comprising a seat member, a back rest extending generally upwardly from said seat member, and a support member fixed to said seat member and said back rest for selectively maintaining the relative positions of said seat member and said back rest, the improvement wherein said seat member includes a pair of generally parallel leg members, a first bent portion connects said leg members, said first bent portion curving out of the plane of said leg members for providing a rear support for said chair, and a seat sling extends between said leg members of said seat member, said back rest includes a pair of normally parallel leg members, each leg member of said pair of leg members of said back rest being pivotally fixed to one of said leg members of said pair of leg members of said seat member, a second bent portion like said first bent portion connects said pair of leg members of said back rest, and a back sling extends between said leg members of said back rest, said support member includes a pair of normally parallel leg members, a third bent portion like said first bent portion connects said leg members of said support member, said third bent portion curving out of the plane of said leg members of said support member for providing a front support for said chair, the extending ends of said leg members of said support member being selectively movable outwardly to be fixable to receiving means on said leg members of said back rest, said leg members of said support member being pivotally fixed to said leg members of said seat member adjacent to said third bent portion, the arrangement being such that said leg members of said back rest span said leg members of said seat member, and first pintle means fix said back rest to said seat member, and said leg members of said support member span said leg members of said back rest and said seat member, second pintle means pivotally fix said leg members of said support member to said leg members of said seat member, and third pintle means selectively fix said leg members of said support member to said back rest.

2. In a beach chair as claimed in claim 1, the further improvement wherein said receiving means on said leg members of said back rest define a plurality of holes therein, said third pintle means are carried on said extending ends of said leg members of said support member, said third pintle means extending towards said back rest, said plurality of holes in said leg members of said back rest being adapted selectively to receive said third pintle means on said leg members of said support member, said back rest being pivotal with respect to said seat member for placing one hole of said plurality of holes in line with said third pintle means.

3. In a beach chair as claimed in claim 2, the further improvement including a leg rest selectively fixable to said chair, said leg rest including a pair of normally parallel leg members, a fourth bent portion like said first bent portion connecting said leg members of said leg rest, said fourth bent portion curving out of the plane of said leg members of said leg rest for providing a support for said leg rest.

4. In a beach chair as claimed in claim 3, the improvement wherein the extending ends of said leg members of said leg rest define holes therein, said second pintle means including an outwardly directed pintle selectively receivable in said hole in said leg members of said leg rest, said leg members of said leg rest being movable apart for selective engagement with said second pintle means.

5. In a beach chair as claimed in claim 4, the improvement including a leg sling carried between said leg members of said leg rest, said leg sling being trapezoidally shaped and slidable towards said fourth bent portion for allowing separation of said leg members to engage said second pintle means and slidable towards said extending ends to prevent separation of said leg members and hold said leg members on said second pintle means.

6. In a beach chair as claimed in claim 2, the further improvement including roller means on said first bent portion, said roller means comprising at least one sleeve surrounding said first bent portion between said leg members of said seat member.

* * * * *